US011747061B2

(12) United States Patent
Numata et al.

(10) Patent No.: US 11,747,061 B2
(45) Date of Patent: Sep. 5, 2023

(54) SHELL-AND-PLATE HEAT EXCHANGER

(71) Applicant: DAIKIN INDUSTRIES, LTD., Osaka (JP)

(72) Inventors: Mitsuharu Numata, Osaka (JP); Yutaka Shibata, Osaka (JP); Kou Terai, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/860,617

(22) Filed: Jul. 8, 2022

(65) Prior Publication Data

US 2022/0341637 A1 Oct. 27, 2022

Related U.S. Application Data

(63) Continuation of application No. PCT/JP2020/043546, filed on Nov. 24, 2020.

(30) Foreign Application Priority Data

Jan. 14, 2020 (JP) ..... 2020-003842

(51) Int. Cl.
*F25B 39/04* (2006.01)
*F28D 9/00* (2006.01)
(Continued)

(52) U.S. Cl.
CPC ..... *F25B 39/04* (2013.01); *F28D 9/00* (2013.01); *F28F 3/04* (2013.01); *F28F 3/08* (2013.01); *F28F 9/02* (2013.01); *F28F 9/22* (2013.01)

(58) Field of Classification Search
CPC ..... F25B 39/04; F28D 9/00; F28F 3/04; F28F 3/08; F28F 9/02; F28F 9/22
(Continued)

(56) References Cited

U.S. PATENT DOCUMENTS 2,587,116 A * 2/1952 Clay ..... F02G 1/055 29/890.039
2,687,876 A * 8/1954 Pontus ..... F28D 9/00 165/170
(Continued)

FOREIGN PATENT DOCUMENTS

CN 110268216 A 9/2019
CN 110431663 A 11/2019
(Continued)

OTHER PUBLICATIONS

International Preliminary Report of corresponding PCT Application No. PCT/JP2020/043546 dated Jul. 28, 2022.
(Continued)

*Primary Examiner* — Tho V Duong
*Assistant Examiner* — Raheena R Malik
(74) *Attorney, Agent, or Firm* — Global IP Counselors, LLP

(57) ABSTRACT

A shell and plate heat exchanger includes a shell forming an internal space, and a plate stack housed in the internal space. The plate stack includes a plurality of heat transfer plates stacked and joined together. The shell and plate heat exchanger allows a refrigerant that has flowed into the internal space to be condensed. A refrigerant channel communicates with the internal space and allows the refrigerant to flow through. A heating medium channel is blocked from the internal space and allows a heating medium to flow through. The refrigerant channel and the heating medium channel are alternately arranged between adjacent heat transfer plates. A meandering portion is provided in at least a lower portion of the plate stack. The meandering portion is configured to meander the refrigerant condensed on a surface of each of the heat transfer plates. The meandering portion is provided by processing the heat transfer plates.

15 Claims, 16 Drawing Sheets

(51) Int. Cl.

| | |
|---|---|
| ***F28F 3/04*** | (2006.01) |
| ***F28F 3/08*** | (2006.01) |
| ***F28F 9/02*** | (2006.01) |
| ***F28F 9/22*** | (2006.01) |

(58) Field of Classification Search
USPC ..... 165/143
See application file for complete search history.

(56) References Cited

U.S. PATENT DOCUMENTS 3,249,155 A * 5/1966 Huet ..... F28D 9/00 165/DIG. 356
3,631,923 A * 1/1972 Izeki ..... F28B 9/08 165/DIG. 185
3,840,070 A * 10/1974 Becker ..... F28F 3/046 165/110
3,862,661 A * 1/1975 Kovalenko ..... F28F 3/046 165/166
4,182,410 A * 1/1980 Yoshida ..... F28B 9/08 165/DIG. 185
4,182,411 A * 1/1980 Sumitomo ..... F28F 13/04 165/DIG. 185
4,230,179 A 10/1980 Uehara et al.
4,237,970 A * 12/1980 Uehara ..... F28F 3/046 165/DIG. 185
4,313,494 A * 2/1982 Bengtsson ..... F28D 9/0037 165/166
6,098,701 A * 8/2000 Blomgren ..... F28F 3/083 165/906
6,817,406 B1 * 11/2004 Inoue ..... F28F 9/0221 261/DIG. 11
9,441,523 B2 * 9/2016 Nilsson ..... B01J 35/04
2005/0082049 A1 * 4/2005 Brost ..... F28D 9/005 165/166
2006/0191672 A1 8/2006 Stenhede et al.
2014/0026608 A1 1/2014 Manzo et al.
2017/0176066 A1 6/2017 Schreiber et al.
2018/0112935 A1 4/2018 Seo
2018/0231274 A1 * 8/2018 Jeong ..... F24H 1/44
2019/0331426 A1 10/2019 Granryd et al.

FOREIGN PATENT DOCUMENTS

JP 47-14301 5/1972
JP 2006-527835 A 12/2006
JP 2018-204887 A 12/2018
KR 2018-0132237 A 12/2018

OTHER PUBLICATIONS

International Search Report of corresponding PCT Application No. PCT/JP2020/43546 dated Feb. 9, 2021.
European Search Report of corresponding EP Application No. 20 91 4230.6 dated Dec. 5, 2022.

* cited by examiner

SHELL-AND-PLATE HEAT EXCHANGER

CROSS-REFERENCE TO RELATED APPLICATIONS

This is a continuation of International Application No. PCT/JP2020/043546 filed on Nov. 24, 2020, which claims priority to Japanese Patent Application No. 2020-003842, filed on Jan. 14, 2020. The entire disclosures of these applications are incorporated by reference herein.

BACKGROUND

Technical Field

The present disclosure relates to a shell-and-plate heat exchanger.

Background Art

A shell-and-plate heat exchanger as disclosed by Patent Document 1 has been known. This shell-and-plate heat exchanger includes a plate stack having a plurality of heat transfer plates and a shell housing the plate stack.

In the heat exchanger of Japanese Unexamined Patent Publication No. 2006-527835, the plate stack is immersed in a liquid refrigerant stored in the shell. The liquid refrigerant in the shell evaporates when the liquid refrigerant exchanges heat with a heating medium flowing through the plate stack, and flows out of the shell through a refrigerant outlet formed in the top of the shell.

SUMMARY

A first aspect of the present disclosure is directed to a shell and plate heat exchanger including a shell forming an internal space, and a plate stack housed in the internal space of the shell. The plate stack includes a plurality of heat transfer plates stacked and joined together. The shell and plate heat exchanger is configured to allow a refrigerant that has flowed into the internal space of the shell to be condensed. A refrigerant channel communicates with the internal space of the shell and is configured to allow the refrigerant to flow through. A heating medium channel is blocked from the internal space of the shell and is configured to allow a heating medium to flow through. The refrigerant channel and the heating medium channel are alternately arranged between adjacent plates of the plurality of heat transfer plates. A meandering portion is provided in at least a lower portion of the plate stack. The meandering portion is configured to meander the refrigerant condensed on a surface of each of the plurality of heat transfer plates. The meandering portion is provided by processing the plurality of heat transfer plates.

DETAILED DESCRIPTION OF EMBODIMENT(S)

First Embodiment

A first embodiment will be described. A shell-and-plate heat exchanger (1) (which will be hereinafter referred to as a "heat exchanger") of this embodiment is a condenser. The heat exchanger (1) of this embodiment is provided in a refrigerant circuit of a refrigeration apparatus that performs a refrigeration cycle, and heats a heating medium with a refrigerant. Examples of the heating medium include water and brine.

Figure 1:
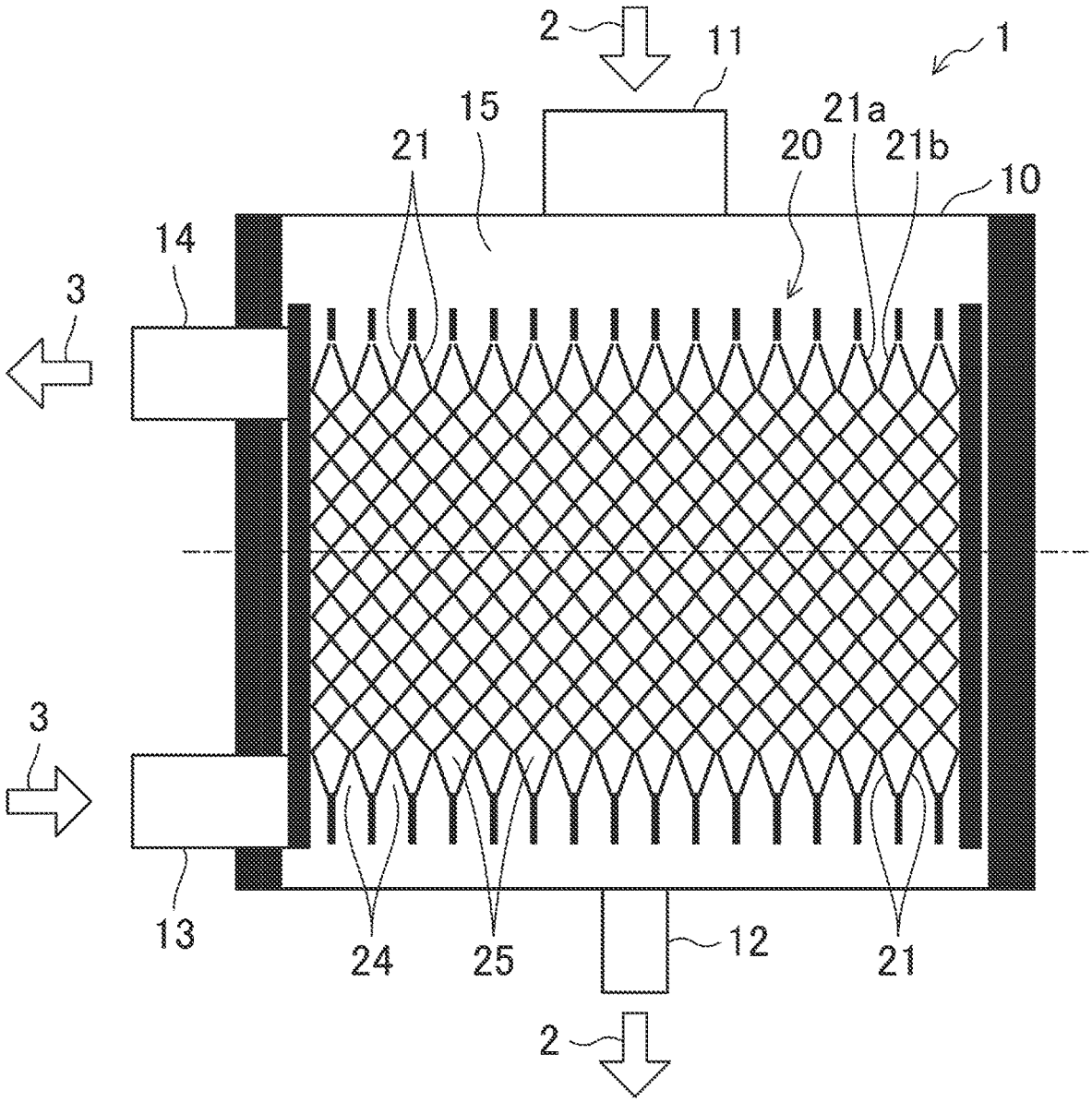
FIG. 1 is a diagram illustrating a cross-sectional configuration of a shell-and-plate heat exchanger according to first and second embodiments, as viewed from a horizontal direction perpendicular to a stacking direction of heat transfer plates.

As illustrated in FIG. 1, the heat exchanger (1) of this embodiment includes a shell (10) and a plate stack (20). The plate stack (20) is housed in an internal space (15) of the shell (10).

Shell

The shell (10) is in the shape of a cylinder with both ends closed. The shell (10) is arranged so that its longitudinal direction coincides with a horizontal direction. The shell (10) is provided with a refrigerant introduction port (11) and a refrigerant discharge port (12). The refrigerant introduction port (11) introduces a refrigerant (2) into an internal space (15) of the shell (10). The refrigerant introduction port (11) is disposed at the top of the shell (10) near the center in the width direction of FIG. 1, for example. The refrigerant introduction port (11) is connected to a compressor of a refrigeration apparatus via a pipe. The refrigerant discharge port (12) discharges the condensed refrigerant (2) from the internal space (15) of the shell (10). The refrigerant discharge port (12) is disposed at the bottom of the shell (10) near the center in the width direction of FIG. 1, for example. The refrigerant discharge port (12) is connected to an evaporator of the refrigeration apparatus via a pipe.

The shell (10) is provided with a heating medium inlet (13) and a heating medium outlet (14). The heating medium inlet (13) and the heating medium outlet (14) are tubular members. The heating medium inlet (13) passes through a lower portion of the left end of the shell (10) in FIG. 1 and is connected to a lower portion of a plate stack (20), for example. The heating medium outlet (14) passes through an upper portion of the left end of the shell (10) in FIG. 1 and is connected to an upper portion of the plate stack (20), for example. The heating medium inlet (13) is connected to a heating medium introduction path of the plate stack (20) to supply a heating medium (3) to the plate stack (20). The heating medium outlet (14) is connected to a heating medium emission path of the plate stack (20) to emit the heating medium (3) out of the plate stack (20).

Plate Stack

As illustrated in FIG. 1, the plate stack (20) includes a plurality of heat transfer plates (21) stacked together. The plate stack (20) is housed in the internal space (15) of the shell (10) so that the stacking direction of the heat transfer plates (21) coincides with the horizontal direction. The plate stack (20) is positioned near the bottom of the internal space (15) of the shell (10).

Figure 2:
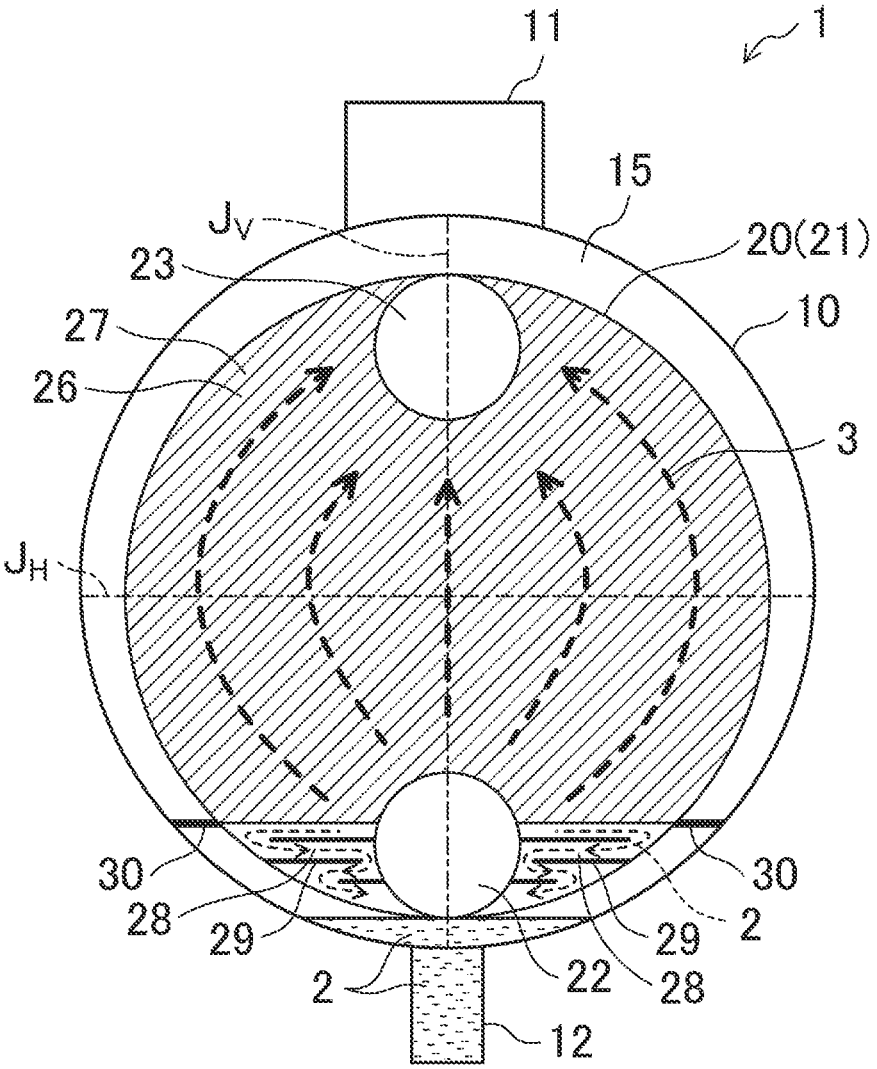
FIG. 2 is a diagram illustrating a cross-sectional configuration of the shell-and-plate heat exchanger according to the first embodiment, as viewed from the stacking direction of the heat transfer plates.

As illustrated in FIG. 2, the heat transfer plates (21) constituting the plate stack (20) are substantially circular plate-shaped members, for example. The heat transfer plates (21) have a first through hole (22) that serves as a heating medium introduction opening, and a second through hole (23) that serves as a heating medium emission opening. The first through hole (22) and the second through hole (23) penetrate the heat transfer plates (21) in the thickness direction. The first through hole (22) and the second through hole (23) are formed in lower and upper portions of the heat transfer plates (21), respectively, for example. Each of the first through hole (22) and the second through hole (23) is a circular hole having a substantially equal diameter, for example. The center of each of the first through hole (22) and the second through hole (23) is positioned on a vertical axis Jv of the heat transfer plates (21), for example. A vertical axis passing through the center of the heat transfer plates (21) is referred to as the vertical axis Jv, and a horizontal axis passing through the center of the heat transfer plates (21) is referred to as a horizontal axis $J_H$.

Although not shown, supports in the shape of protrusions for supporting the plate stack (20) protrude from the inner wall of the shell (10). The plate stack (20) housed in the internal space (15) of the shell (10) is spaced apart from the inner wall of the shell (10), and leaves a space between lower edges of the heat transfer plates (21) constituting the plate stack (20) and the inner wall of the shell (10). The condensed refrigerant is stored in this space.

Figure 3:
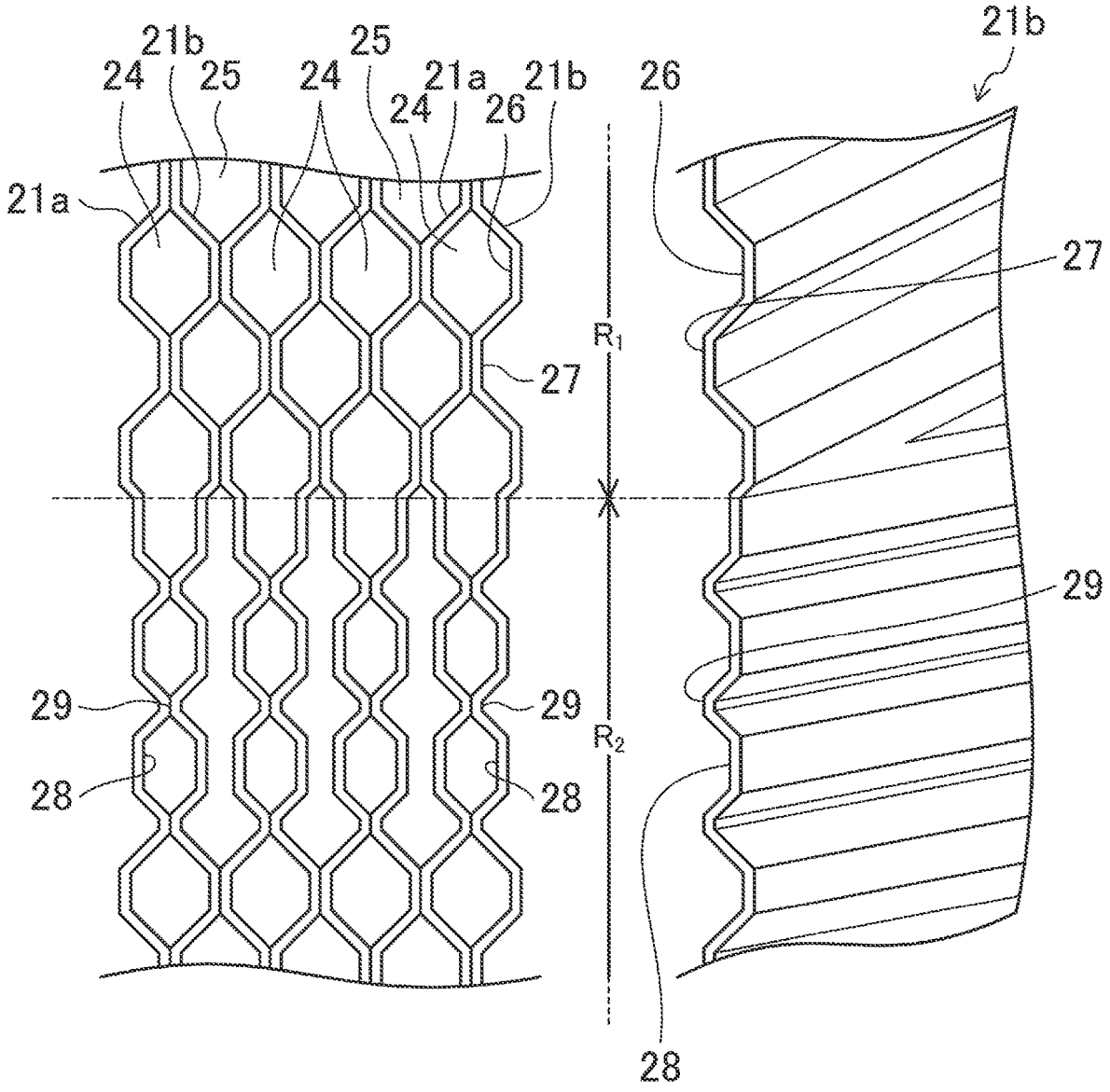
FIG. 3 is a diagram illustrating a cross-sectional configuration of a plate stack of the shell-and-plate heat exchanger according to the first embodiment together with a perspective view of one of the heat transfer plates.

As illustrated in FIG. 3, the heat transfer plates (21) constituting the plate stack (20) include first plates (21*a*) and second plates (21*b*) having different shapes. Each of the second plates (21*b*) may, for example, be a 1800 inversion of the orientation of the first plate (21*a*) around the vertical axis Jv or the horizontal axis $J_H$. The plate stack (20) includes a plurality of first plates (21*a*) and a plurality of second plates (21*b*). The first plates (21*a*) and the second plates (21*b*) are alternately stacked to form the plate stack (20). In the following description, for each of the first plates (21*a*) and the second plates (21*b*), a surface on the right in FIG. 3 will be referred to as a "first surface," and a surface on the left in FIG. 3 will be referred to as a "second surface."

Refrigerant Channel and Heating Medium Channel

The plate stack (20) includes refrigerant channels (24) and the heating medium channels (25), with the heat transfer plate (21*a*, 21*b*) interposed therebetween. The heat transfer plate (21*a*, 21*b*) separates the refrigerant channel (24) from the corresponding heating medium channel (25). Each of the refrigerant channels (24) is a channel sandwiched between the first surface of the first plate (21*a*) and the second surface of the second plate (21*b*). The refrigerant channel (24) communicates with the internal space (15) of the shell (10). Each of the heating medium channels (25) is a channel sandwiched between the second surface of the first plate (21*a*) and the first surface of the second plate (21*b*). The heating medium channel (25) is blocked from the internal space (15) of the shell (10), and communicates with the heating medium inlet (13) and the heating medium outlet (14) attached to the shell (10). The heating medium channels (25) and the heating medium inlet (13) communicate to each other through the first through hole (22) of the heat transfer plates (21*a*, 21*b*). The heating medium channels (25) and the heating medium outlet (14) communicate to each other through the second through hole (23) of the heat transfer plates (21*a*, 21*b*). That is, the heating medium (3) introduced from the heating medium inlet (13) flows into the heating medium channels (25) through the first through hole (22) of the heat transfer plates (21*a*, 21*b*). Thereafter, the heating medium (3) flows out of the heating medium channels (25) through the second through hole (23) of the heat transfer plates (21*a*, 21*b*), and is then emitted through the heating medium outlet (14).

Corrugated Pattern for Promoting Condensation of Refrigerant

As illustrated in FIGS. 2 and 3, each of the first plate (21*a*) and the second plate (21*b*) has a corrugated pattern, such as a herringbone pattern, including a recess (26) and a protrusion (27) for promoting the condensation of the refrigerant (2). The corrugated pattern including the recess (26) and the protrusion (27) is formed in a condensation region $R_1$ excluding a lower portion (a supercooling region $R_2$ which will be described later) in each of the first plate (21*a*) and the second plate (21*b*). In the first plate (21*a*), the recess (26) is dented toward the second surface side of the first plate (21*a*), and the protrusion (27) bulges toward the first surface side of the first plate (21*a*). In the second plate (21*b*), the recess (26) is dented toward the first surface side of the second plate (21*b*), and the protrusion (27) bulges toward the second surface side of the second plate (21*b*). The cross-sectional configuration illustrated in FIG. 3 is a cross-sectional configuration of the plate stack (20) at a portion where the protrusion (27) of the first plate (21*a*) and the protrusion (27) of the second plate (21*b*) are in contact with each other.

As the corrugated pattern including the recess (26) and the protrusion (27), patterns, such as one including repetition of long and narrow ridges and grooves and one including ridge lines and groove lines extending along the horizontal direction, may be used instead of the herringbone pattern. Alternatively, dimple patterns may be used instead of the corrugated pattern.

Heating Medium Introduction Path and Heating Medium Emission Path

In the plate stack (20), the first through hole (22) of each first plate (21*a*) overlaps the first through hole (22) of an adjacent one of the second plates (21*b*) on the first surface side of the first plate (21*a*), and the rims of the overlapping first through holes (22) are welded together along the whole perimeter. In the plate stack (20), the second through hole (23) of each first plate (21*a*) overlaps the second through hole (23) of an adjacent one of the second plates (21*b*) on the first surface side of the first plate (21*a*), and the rims of the overlapping second through holes (23) are welded together along the whole perimeter. The peripheral portion of the first plate (21*a*) on the first surface side and the peripheral portion, on the second surface side, of an adjacent one of the second plates (21*b*) that is adjacent to the first surface side of the first plate (21*a*) are spaced apart from each other and are open. This configuration forms a refrigerant channel (24) between a first surface of the first plate (21*a*) and a second surface of the second plate (21*b*) adjacent to the first surface of the first plate (21*a*). The refrigerant channel (24) is blocked from a heating medium introduction path and a heating medium emission path, which will be described later, and communicates with the internal space (15) of the shell (10) and allows the refrigerant (2) to flow.

On the other hand, on the plate stack (20), each first plate (21*a*) and an adjacent one of the second plates (21*b*) on the second surface side of the first plate (21*a*) are welded together at their peripheral portions along the whole perimeter. In the plate stack (20), the first through hole (22) in each of the first plates (21*a*) and the first through hole (22) in each of the second plates (21*b*) form the heating medium introduction path. The heating medium introduction path is a passage extending along the stacking direction of the heat transfer plates (21*a*. 21*b*) in the plate stack (20). In the plate stack (20), the second through hole (23) in each of the first plates (21*a*) and the second through hole (23) in each of the second plates (21*b*) form the heating medium emission path. The heating medium emission path is a passage extending along the stacking direction of the heat transfer plates (21*a*, 21*b*) in the plate stack (20). As described above, there is formed a heating medium channel (25) between a second surface of the first plate (21*a*) and a first surface of the second plate (21*b*) adjacent to the second surface of the first plate (21*a*). The heating medium channel (25) is blocked from the internal space (15) of the shell (10) and communicates with the above-mentioned heating medium introduction path and the heating medium emission path and allows the heating medium (3) to flow.

The heating medium introduction path is a passage blocked from the internal space (15) of the shell (10), and allows all the heating medium channels (25) to communicate with the heating medium inlet (13). The heating medium emission path is a passage blocked from the internal space (15) of the shell (10), and allows all the heating medium channels (25) to communicate with the heating medium outlet (14).

Corrugated Pattern that Makes Refrigerant Meander

As illustrated in FIGS. 2 and 3, among the plurality of heat transfer plates (21), at least one of a pair of plates (21*a*, 21*b*) sandwiching the refrigerant channel (24) has, on a surface of a lower portion (the supercooling region $R_2$), a meandering portion (28, 29) that meanders the refrigerant (2) condensed on that surface, specifically a corrugated pattern including a recess (28) and a protrusion (29). The supercooling region $R_2$ may be provided, for example, on both sides of the first through hole (22) in the horizontal direction, more specifically, on both sides of the first through hole (22) in the horizontal direction except an upper portion of the first through hole (22). The supercooling region $R_2$ includes, for example, a plurality of protrusions (29) that extend along the horizontal direction and form a zigzag pattern so that the refrigerant (2) can meander along the recesses (28). In the first plate (21*a*), the recess (28) is dented toward the second surface side of the first plate (21*a*), and the protrusion (29) bulges toward the first surface side of the first plate (21*a*). In the second plate (21*b*), the recess (28) is dented toward the first surface side of the second plate (21*b*), and the protrusion (29) bulges toward the second surface side of the second plate (21*b*). The cross-sectional configuration illustrated in FIG. 3 is a portion where the protrusion (29) of the first plate (21*a*) and the protrusion (29) of the second plate (21*b*) are in contact with each other.

Although not shown, in order to ensure the strength of the heating medium channel (25) in the supercooling region $R_2$, a plurality of dimple projections may be provided which protrude from the recesses (28) of the first and second plates (21*a*) and (21*b*) toward the heating medium channel (25) so as to be in contact with each other.

Further, as illustrated in FIG. 2, a member (filling) (30) that inhibits entering of the refrigerant (2) may be provided between an outer periphery of the supercooling region $R_2$ of the plate stack (20) and the inner wall of the shell (10) in order to prevent the condensed refrigerant from bypassing the recess (28) and the protrusion (29) (meandering portion (28, 29)) of the supercooling region $R_2$ and flowing between the outer periphery of the plate stack (20) and the inner wall of the shell (10).

Flows of Refrigerant and Heating Medium in Heat Exchanger

Flows of the refrigerant and the heating medium in the heat exchanger (1) of this embodiment will be described below.

Flow of Refrigerant

The heat exchanger (1) receives a high-pressure refrigerant in a gas phase state that has passed through the compressor of the refrigerant circuit. The refrigerant (2) to be supplied to the heat exchanger (1) is supplied to the refrigerant channels (24) of the plate stack (20) from the refrigerant introduction port (11). Heat of the refrigerant (2) supplied to the refrigerant channels (24) is absorbed by the heating medium flowing through the heating medium channels (25) and is condensed, on the first surface of first plate (21*a*) or the second surface of the second plate (21*b*) in the condensation region $R_1$. The condensed refrigerant (2) flows downward along the corrugated pattern including the recess (26) and protrusion (27) in the condensation region $R_1$. The condensed refrigerant (2), when reaching the supercooling region $R_2$, flows along the corrugated pattern (meandering portion (28, 29)) including the recess (28) and the protrusion (29) in the supercooling region $R_2$ while meandering, falls from a lower edge of the heat transfer plate (21*a*, 21*b*), and is stored temporarily at the bottom of the internal space (15) of the shell (10). The condensed refrigerant (2) is thereafter discharged from the internal space (15) of the shell (10) through the refrigerant discharge port (12). The refrigerant (2) discharged from the internal space (15) of the shell (10) is introduced in the evaporator of the refrigeration apparatus.

Flow of Heating Medium

The heating medium to be supplied to the heat exchanger (1) flows into the heating medium introduction path of the plate stack (20) through the heating medium inlet (13), and is distributed to the heating medium channels (25). The heating medium that has flowed into each heating medium channel (25) flows generally upward while spreading in the width direction of the heat transfer plates (21*a*, 21*b*). The heating medium flowing in the heating medium channels (25) absorbs heat from the refrigerant flowing in the refrigerant channels (24). This increases the temperature of the heating medium.

The heating medium heated while flowing through each heating medium channel (25) flows into the heating medium emission path of the plate stack (20) and merges with the flows of the heating medium that have passed through the other heating medium channels (25). Then, the heating medium flows out of the heat exchanger (1) through the heating medium outlet (14) and is used for the purposes such as air conditioning.

Advantages of First Embodiment

In the heat exchanger (1) of this embodiment, among the plurality of heat transfer plates (21), at least one of a pair of plates (21*a*, 21*b*) sandwiching the refrigerant channel (24) has, on a surface of a lower portion, the recess (28) and the protrusion (29) which forms the meandering portion (28, 29) that meanders the refrigerant (2) condensed on that surface. The meandering of the condensed refrigerant (2) increases the flow speed of the refrigerant (2), making it possible to ensure the sufficient area for supercooling of the refrigerant (2) on the heat transfer plates (21) and improve the heat exchange efficiency. Further, if the recess and protrusion (28, 29) are arranged, for example, in a zigzag pattern, an increase in the number of angles in the zigzag can lengthen the channel length of the refrigerant (2), thus enabling stable supercooling of the refrigerant (2).

In the heat exchanger (1) of this embodiment, the following effects are obtainable by the provision of the meandering portion (28, 29) (the recess (28) and the protrusion (29)) on both sides, in the horizontal direction, of the first through hole (22) (the introduction opening for the heating medium (3)) in a surface of at least one of the pair of plates (21*a*, 21*b*). That is, a decrease in the heat exchange efficiency due to the provision of the recess (28) and the protrusion (29) that meander the condensed refrigerant (2) is less likely to occur because both sides of the introduction opening for the heating medium (3) (first through hole (22)) in the horizontal direction are regions that basically contribute less to heat exchange.

In the heat exchanger (1) of this embodiment, the following effects are obtainable by the provision of the member (filling)(30) that inhibits entering of the refrigerant (2) between the outer periphery of the supercooling region $R_2$ in the plate stack (20) where the recess (28) and the protrusion (29) are formed, and the inner wall of the shell (10). That is, the aforementioned effects are obtainable with reliability because it is possible to prevent the condensed refrigerant from bypassing the recess (28) and the protrusion (29), i.e., the meandering portion (28, 29), and flowing between the outer periphery of the plate stack (20) and the inner wall of the shell (10).

Second Embodiment

A second embodiment will be described. The heat exchanger (1) of this embodiment is the heat exchanger (1) of the first embodiment with a modified pattern shape and/or cross-sectional structure of the recess (26) and the protrusion (27) (the corrugated pattern for promoting the condensation of the refrigerant). Thus, the following description will be focused on the differences between the heat exchanger (1) of this embodiment and the heat exchanger (1) of the first embodiment.

Corrugated Pattern for Promoting Condensation of Refrigerant

Figure 4:
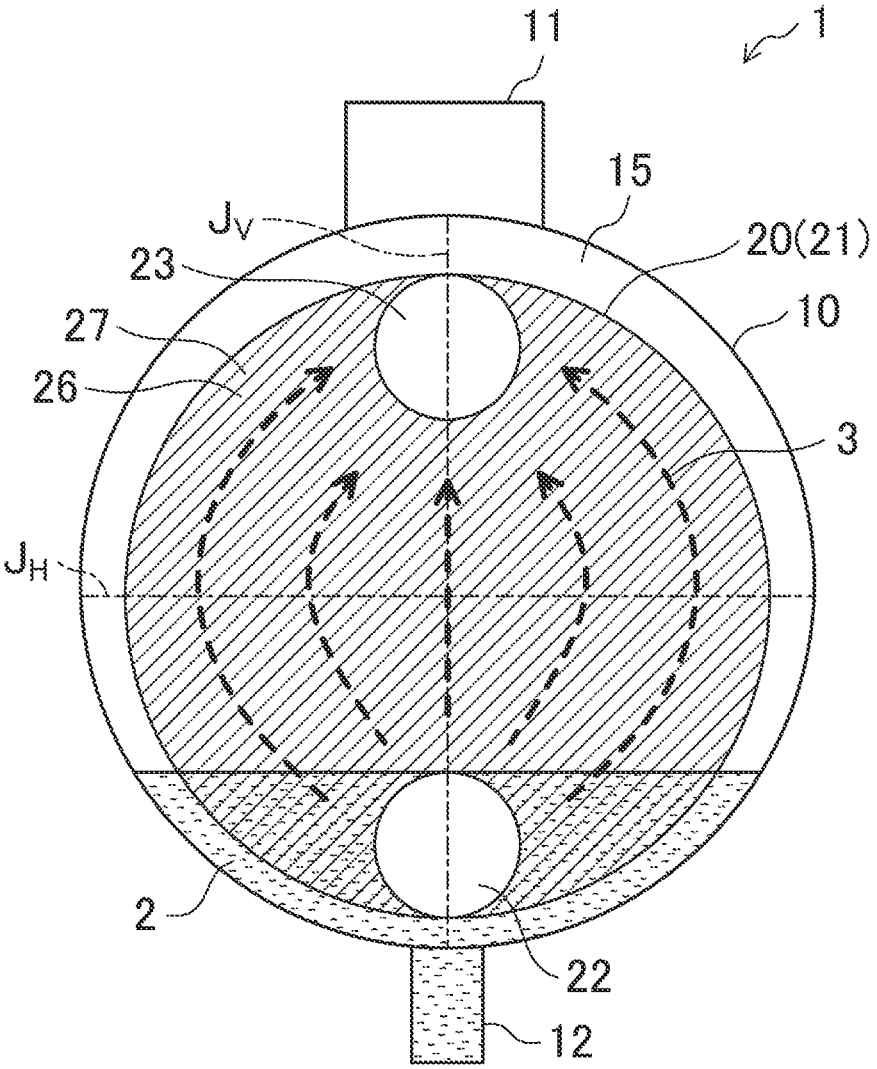
FIG. 4 is a diagram illustrating a cross-sectional configuration of a shell-and-plate heat exchanger according to a second embodiment, as viewed from the stacking direction of the heat transfer plates.
Figure 5:
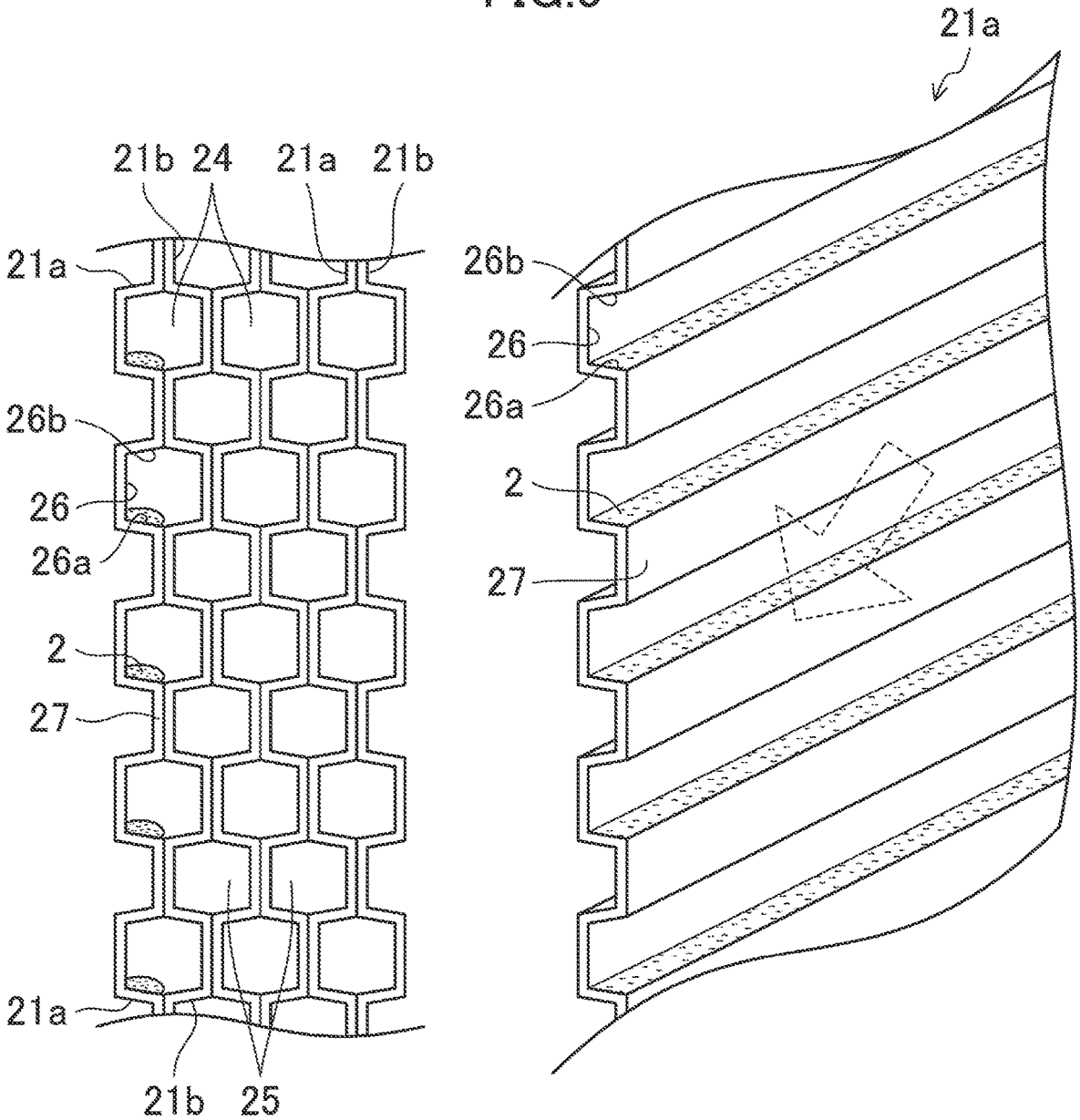
FIG. 5 is a diagram illustrating a cross-sectional configuration of a plate stack of the shell-and-plate heat exchanger according to the second embodiment together with a perspective view of one of the heat transfer plates.

As illustrated in FIGS. 4 and 5, among the plurality of heat transfer plates (21), at least one of a pair of plates (21*a*. 21*b*) sandwiching the refrigerant channel (24) has, on a surface, a recess (26) and a protrusion (27) extending along an inclined direction that is inclined with respect to the horizontal direction. The recess (26) has a structure that promotes a flow of the refrigerant (2) in the inclined direction, such as a structure in which a first wall surface (26*a*) on the lower side of the recess (26) forms a first angle of 450 or less, more preferably 30° or less, with respect to the horizontal direction. The first angle is preferably 10° or more, more preferably 150 or more, since the recess (26) and the protrusion (27) are formed with a die. In the recess (26) illustrated in FIG. 5, a second angle formed by a second wall surface (26*b*) on the upper side of the recess (26) with respect to the horizontal direction is equal to the first angle. In other words, the cross-sectional shape of the recess (26) is symmetric.

In a case in which the first plate (21*a*) of the pair of plates (21*a*, 21*b*) sandwiching the refrigerant channel (24) has this configuration as illustrated in FIG. 5, the second plate (21*b*) may be a 1800 inversion of the orientation of the first plate (21*a*) around the vertical axis Jv.

FIG. 4 illustrates the heat exchanger (1) of the first embodiment without the supercooling region $R_2$. However, the heat exchanger (1) of this embodiment, too, may include a supercooling region $R_2$ (a meandering portion for meandering the refrigerant (a recess (28) and a protrusion (29) or a communication channel (31))) similar to one in the first embodiment or one which will be described later in the third embodiment, and/or a member (filling) (30) that inhibits entering of the refrigerant (2).

In the heat exchanger (1) of this embodiment, the recess (26) and the protrusion (27) are continuous from one end to the other end of the heat transfer plate (21). However, the recess (26) and/or the protrusion (27) may be partially discontinuous to allow for the placement of a reinforcing member for the refrigerant channel (24) and/or the heating medium channel (25), for example.

Advantages of Second Embodiment

In the heat exchanger (1) of this embodiment, at least one of the heat transfer plates (21) sandwiching the refrigerant channel (24) have a recess (26) extending along an inclined direction that is inclined with respect to the horizontal direction, and the recess (26) has a structure that promotes a flow of the refrigerant (2) in the inclined direction. This structure allows the condensed refrigerant (2) to flow in the inclined direction along the recess (26) (see the arrow in broken line on the right side of FIG. 5). Thus, the condensed refrigerant (2) is substantially prevented from flowing downward in the vertical direction and wetting the entire surface of the heat transfer plate (21), which makes it possible to improve the heat exchange efficiency.

First Variation of Second Embodiment

The heat exchanger (1) of this variation is the heat exchanger (1) of the second embodiment with a modified cross-sectional structure of the recess (26) and the protrusion (27) (the corrugated pattern for promoting the condensation of the refrigerant) while maintaining the same pattern shape of the recess (26) and the protrusion (27). Thus, the following description will be focused on the differences between the heat exchanger (1) of this variation and the heat exchanger (1) of the second embodiment.

Figure 6:
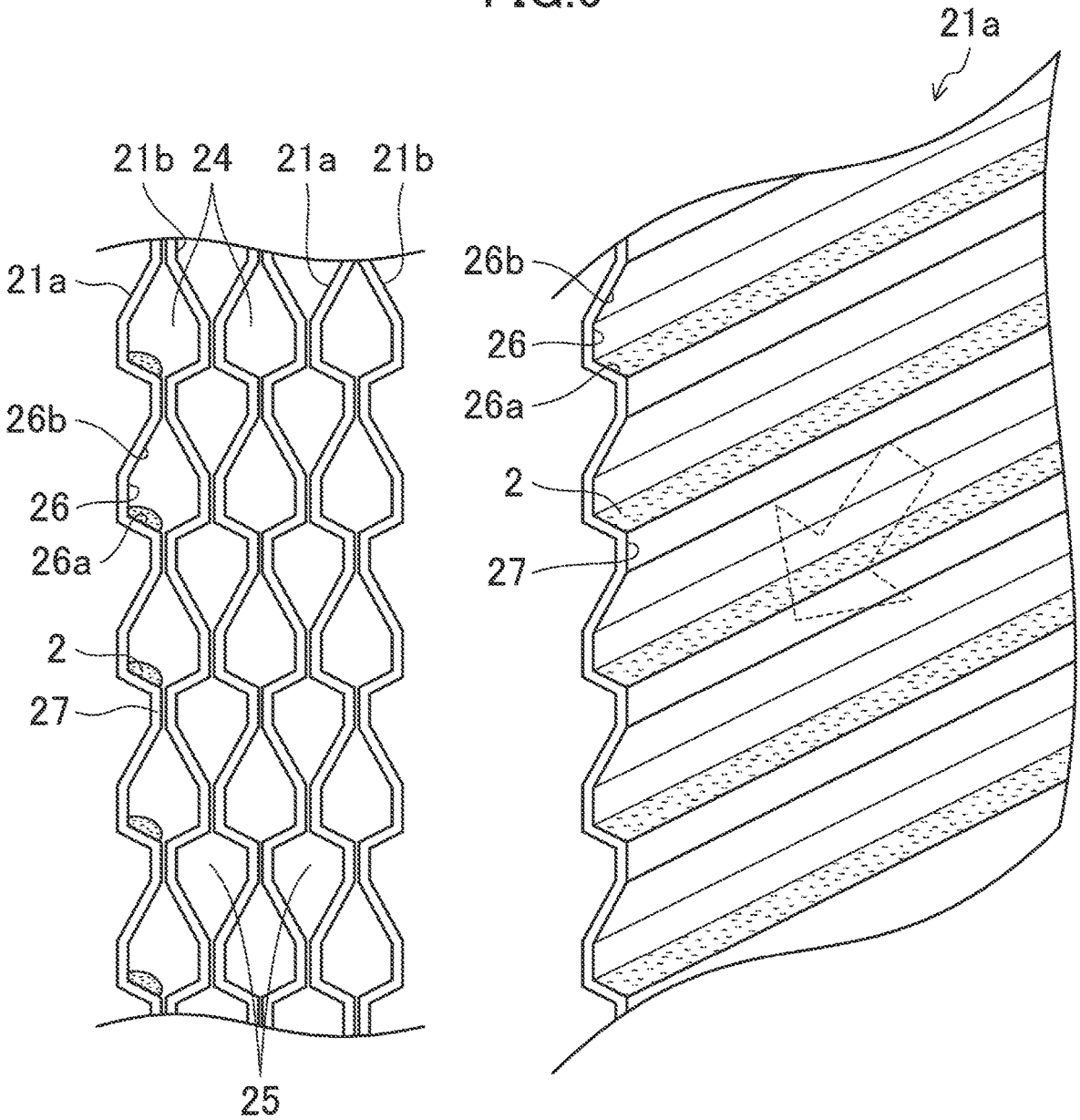
FIG. 6 is a diagram illustrating a cross-sectional configuration of a plate stack of a shell-and-plate heat exchanger according to a first variation of the second embodiment together with a perspective view of one of heat transfer plates.

The recess (26) illustrated in FIG. 6 has an asymmetric cross-sectional shape. A first angle formed by a first wall surface (26*a*) on the lower side of the recess (26) with respect to the horizontal direction is smaller than a second angle formed by a second wall surface (26*b*) on the upper side of the recess (26) with respect to the horizontal direction. The first angle formed by the first wall surface (26*a*) of the recess (26) with respect to the horizontal direction is preferably 10° or more and 45° or less, more preferably 15° or more and 30° or less, for example.

It is difficult to reduce both the first and second angles mentioned above because the recess (26) and the protrusion (27) are formed with a die. However, effects similar to those of the second embodiment are obtainable while avoiding difficulties in manufacturing the die, by reducing only the first angle as in this variation.

Second Variation of Second Embodiment

The heat exchanger (1) of this variation is the heat exchanger (1) of the first variation of the second embodiment with a modified cross-sectional structure of the recess (26) and the protrusion (27) (the corrugated pattern for promoting the condensation of the refrigerant) while maintaining the same pattern shape of the recess (26) and the protrusion (27). Thus, the following description will be focused on the differences between the heat exchanger (1) of this variation and the heat exchanger (1) of the first variation of the second embodiment.

Figure 7:
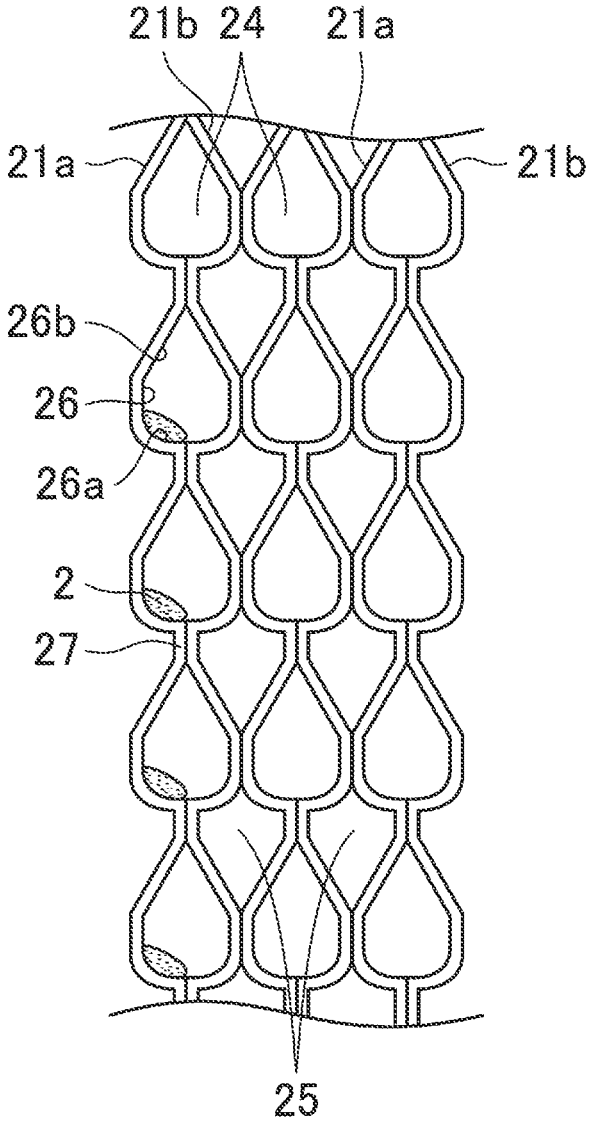
FIG. 7 is a diagram illustrating a cross-sectional configuration of a plate stack of a shell-and-plate heat exchanger according to a second variation of the second embodiment.

A first wall surface (26*a*) of the recess (26) illustrated in FIG. 7 is a modification of the first wall surface (26*a*) on the lower side of the recess (26) in FIG. 6, and has a recessed curved surface. This makes it easier for the first wall surface (26*a*) to block the vertically downward flow of refrigerant (2).

Third Variation of Second Embodiment

The heat exchanger (1) of this variation is the heat exchanger (1) of the first variation of the second embodiment with a modified pattern shape of the recess (26) and the protrusion (27) (the corrugated pattern for promoting the condensation of the refrigerant) while maintaining the same cross-sectional structure of the recess (26) and the protrusion (27). Thus, the following description will be focused on the differences between the heat exchanger (1) of this variation and the heat exchanger (1) of the first variation of the second embodiment.

Figure 8:
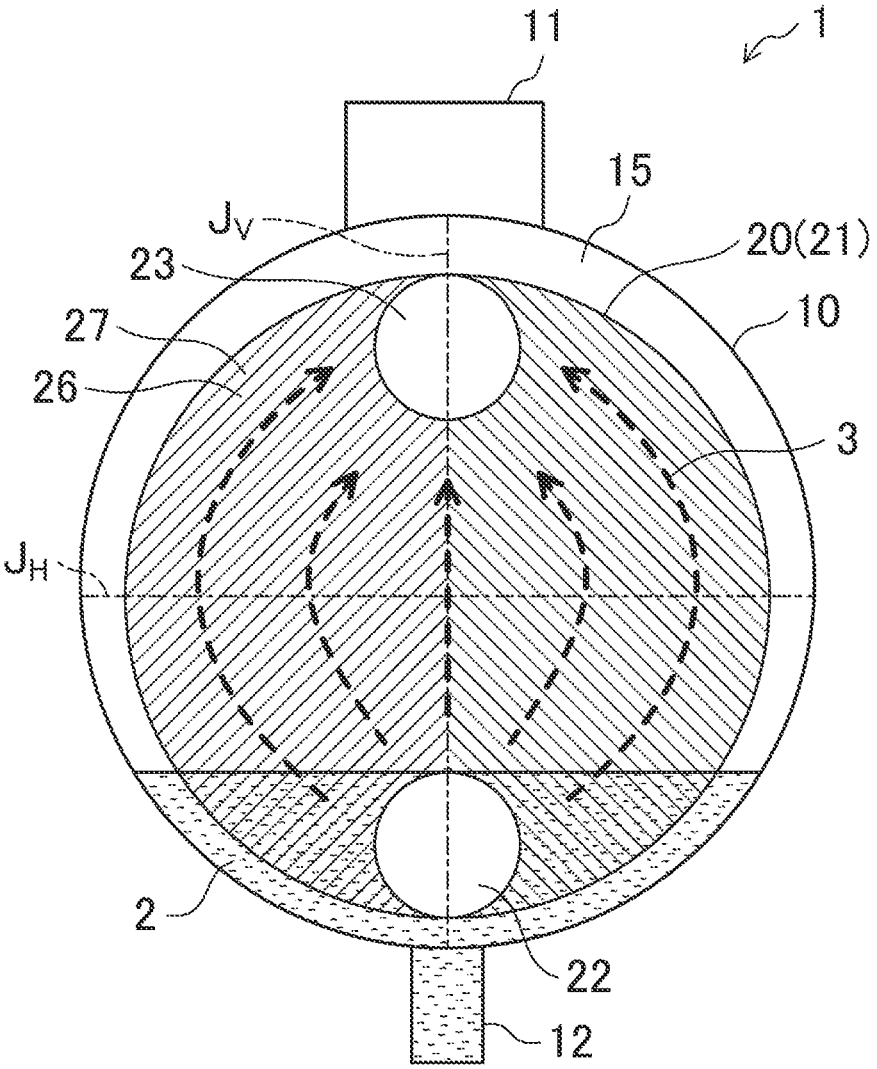
FIG. 8 is a diagram illustrating a cross-sectional configuration of a shell-and-plate heat exchanger according to a third variation of the second embodiment, as viewed from a stacking direction of heat transfer plates.
Figure 9:
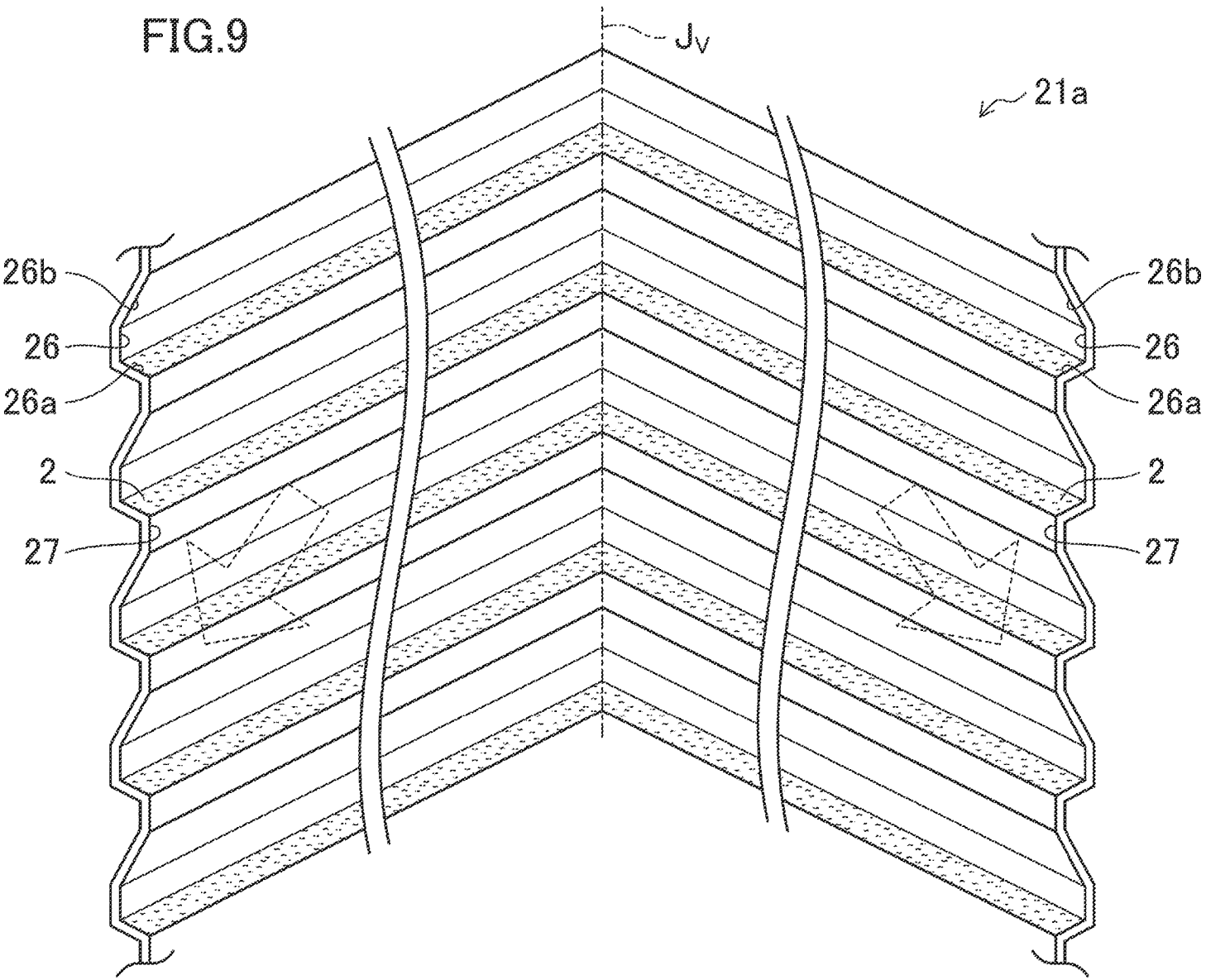
FIG. 9 is a diagram illustrating a perspective view of one of the heat transfer plates that constitute a plate stack of the shell-and-plate heat exchanger according to the third variation of the second embodiment.

As illustrated in FIGS. 8 and 9, the pattern of the recess (26) and the protrusion (27) of this variation is an angle pattern extending diagonally downward to both sides from a central portion in the horizontal direction (i.e., from the vertical axis Jv) on a surface of one of the pair of plates (21*a*, 21*b*) sandwiching the refrigerant channel (24).

In a case in which the first plate (21*a*) of the pair of plates (21*a*, 21*b*) sandwiching the refrigerant channel (24) has the cross-sectional structure of the first variation of the second embodiment (see FIGS. 6 and 7) as illustrated in FIG. 9, the second plate (21*b*) may be a 1800 inversion of the orientation of the first plate (21*a*) around the horizontal axis $J_H$.

According to this variation, the distance that the condensed refrigerant (2) flows along the recess (26) to the edge of the heat transfer plate (21) is shorter compared to a case in which the pattern of the recess (26) extends along one direction from one end to the end of the heat transfer plate (21). This facilitates the flow of the condensed refrigerant (2) to the edge of the heat transfer plate (21) before the condensed refrigerant (2) spills out of the recess (26) and flows vertically downward. Thus, the area of the heat transfer plate (21) that is not wet with the condensed refrigerant (2) can be enlarged, thereby further improving the heat exchange efficiency.

Fourth Variation of Second Embodiment

The heat exchanger (1) of this variation is the heat exchanger (1) of the second embodiment with a modified pattern shape and a modified cross-sectional structure of the recess (26) and the protrusion (27) (the corrugated pattern for promoting the condensation of the refrigerant). Thus, the following description will be focused on the differences between the heat exchanger (1) of this variation and the heat exchanger (1) of the second embodiment.

Figure 10:
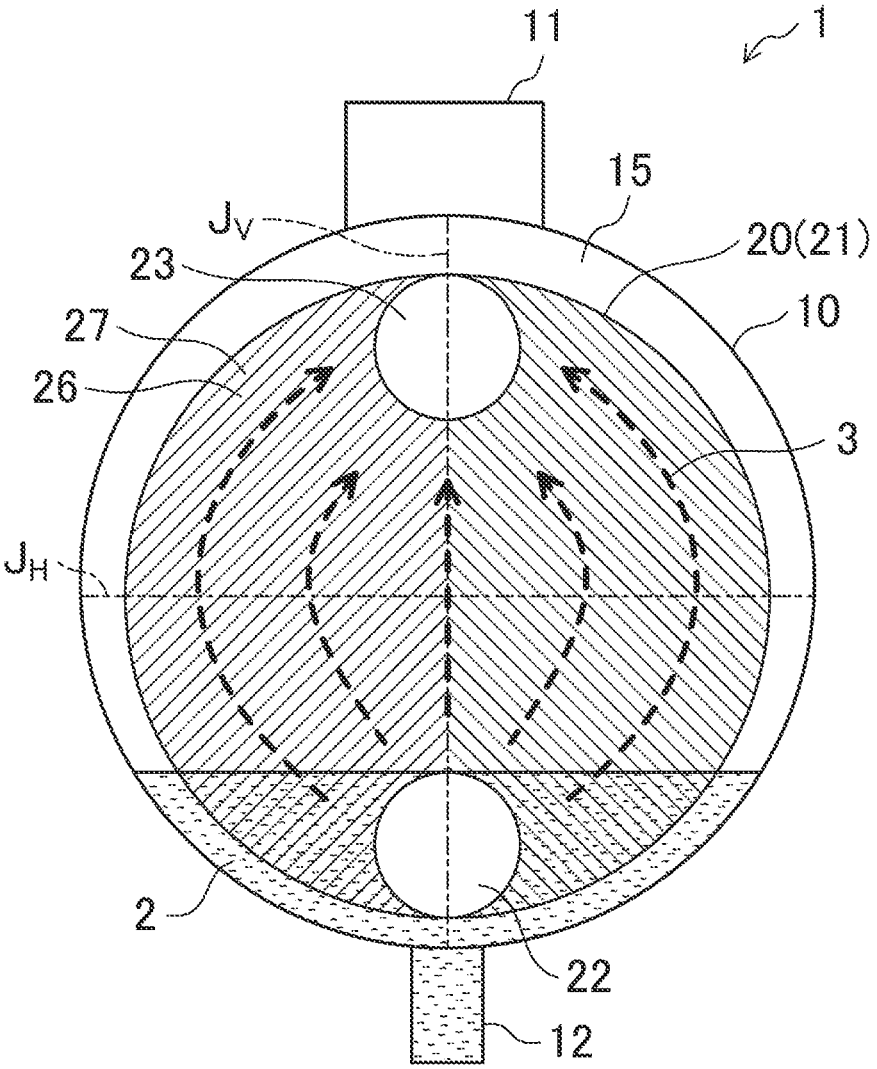
FIG. 10 is a diagram illustrating a cross-sectional configuration of a shell-and-plate heat exchanger according to a fourth variation of the second embodiment, as viewed from a stacking direction of heat transfer plates.
Figure 11:
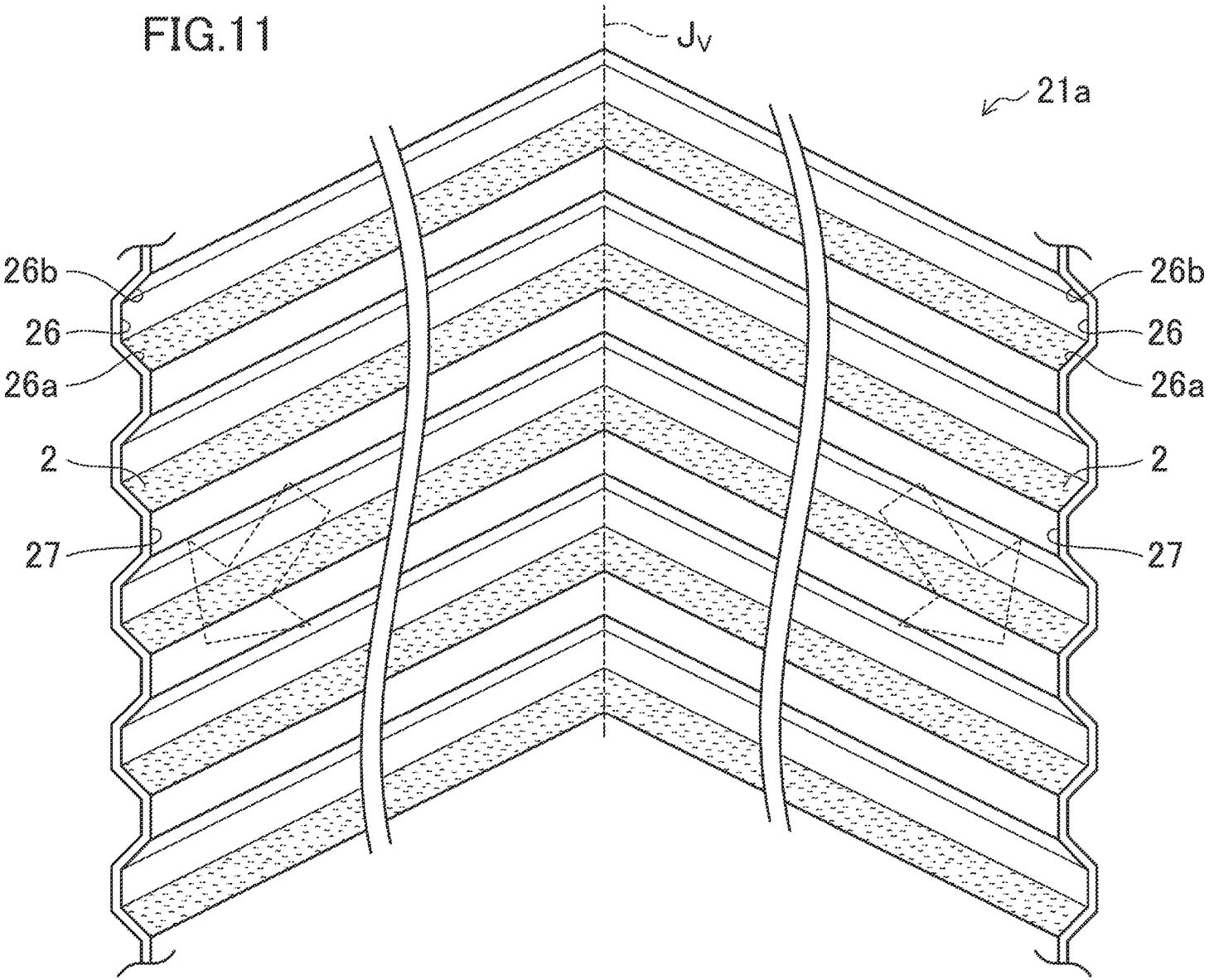
FIG. 11 is a diagram illustrating a perspective view of one of the heat transfer plates that constitute a plate stack of the shell-and-plate heat exchanger according to the fourth variation of the second embodiment.
Figure 12:
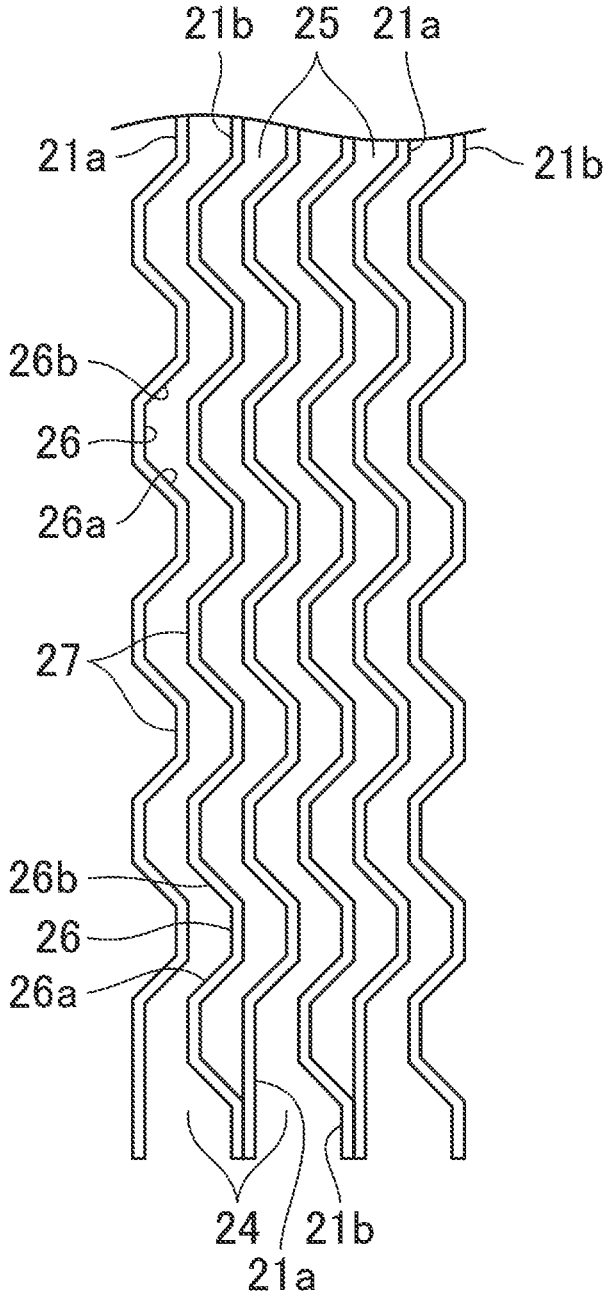
FIG. 12 is a diagram illustrating a cross-sectional configuration of the plate stack of the shell-and-plate heat exchanger according to the fourth variation of the second embodiment.

As illustrated in FIGS. 10 to 12, the pattern of the recess (26) and the protrusion (27) of this variation is an angle pattern extending diagonally downward to both sides from a central portion in the horizontal direction (i.e., from the vertical axis iv) on surfaces of both of the pair of plates (21*a*, 21*b*) sandwiching the refrigerant channel (24).

The pair of plates (21*a*, 21*b*) sandwiching the refrigerant channel (24) has the same cross-sectional shape except the peripheral portions joined together to form the heating medium channels (25).

The recess (26) illustrated in FIGS. 11 and 12 has a symmetric cross-sectional shape. A first angle formed by a first wall surface (26*a*) on the lower side of the recess (26) with respect to the horizontal direction is equal to a second angle formed by a second wall surface (26*b*) on the upper side of the recess (26) with respect to the horizontal direction, which is about 45°, for example.

In this variation, the cross-sectional shape of the recess (26) may be asymmetrical. Alternatively, the first angle may be set to 100 or more and 45° or less, or 15° or more and 30° or less. Alternatively, both of the first angle and the second angle may be set to be less than 45°.

Figure 13:
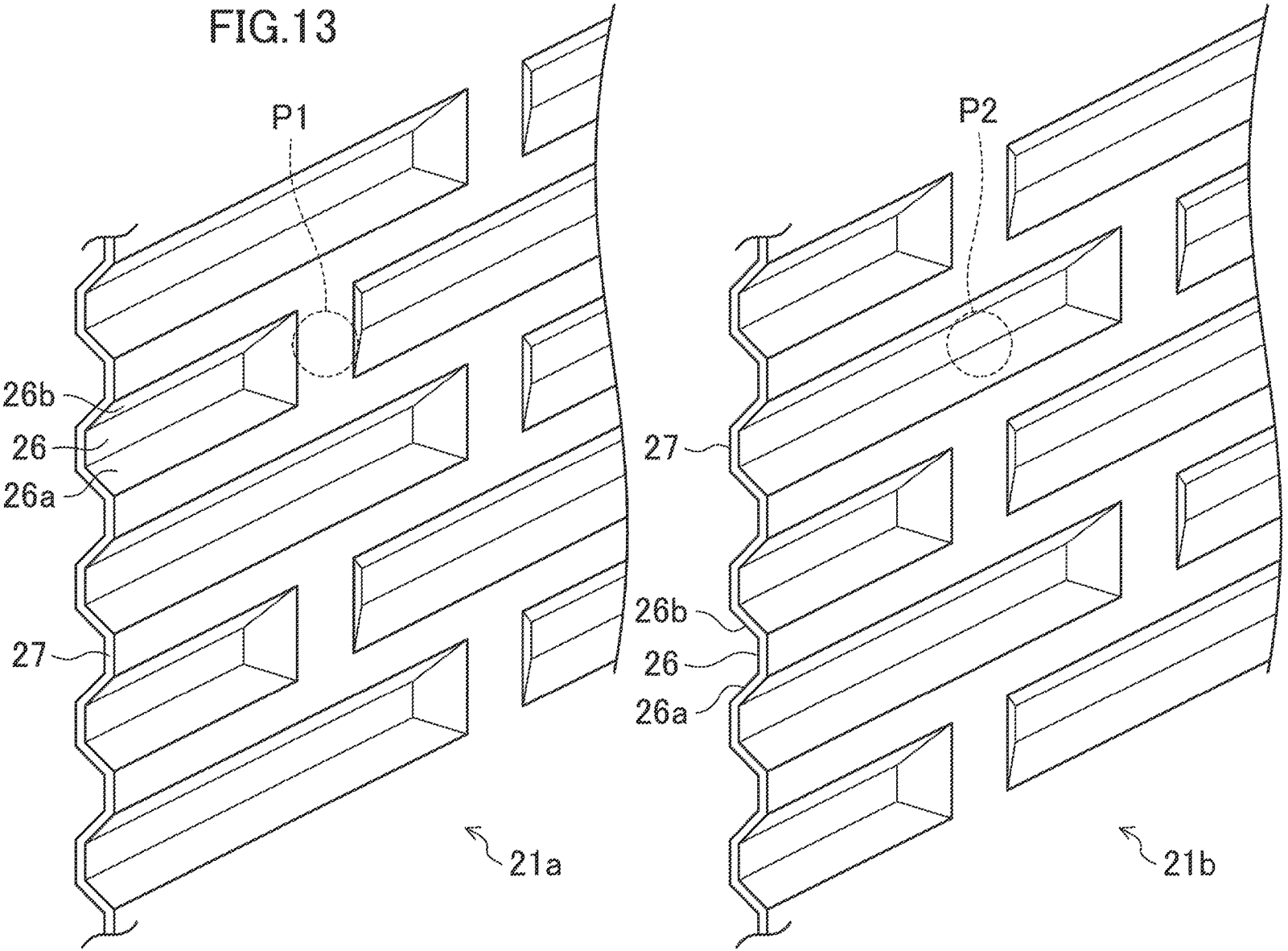
FIG. 13 is a diagram illustrating a perspective view of a pair of heat transfer plates that constitute the plate stack of the shell-and-plate heat exchanger according to the fourth variation of the second embodiment.

In this variation, to reinforce the refrigerant channel (24) and/or the heating medium channel (25), a projected region P1 may be provided in an intermediate portion of the recess (26) extending diagonally downward from the vertical axis Jv, as illustrated in FIG. 13, and the projected region P1 may be brought into contact with a corresponding region P2 of the protrusion (27).

According to this variation described above, the angle pattern of the recess (26) on the surfaces of both of the pair of plates (21*a*, 21*b*) sandwiching the refrigerant channel (24)

produces the effects described in the third variation of the second embodiment more significantly.

Third Embodiment

Figure 14:
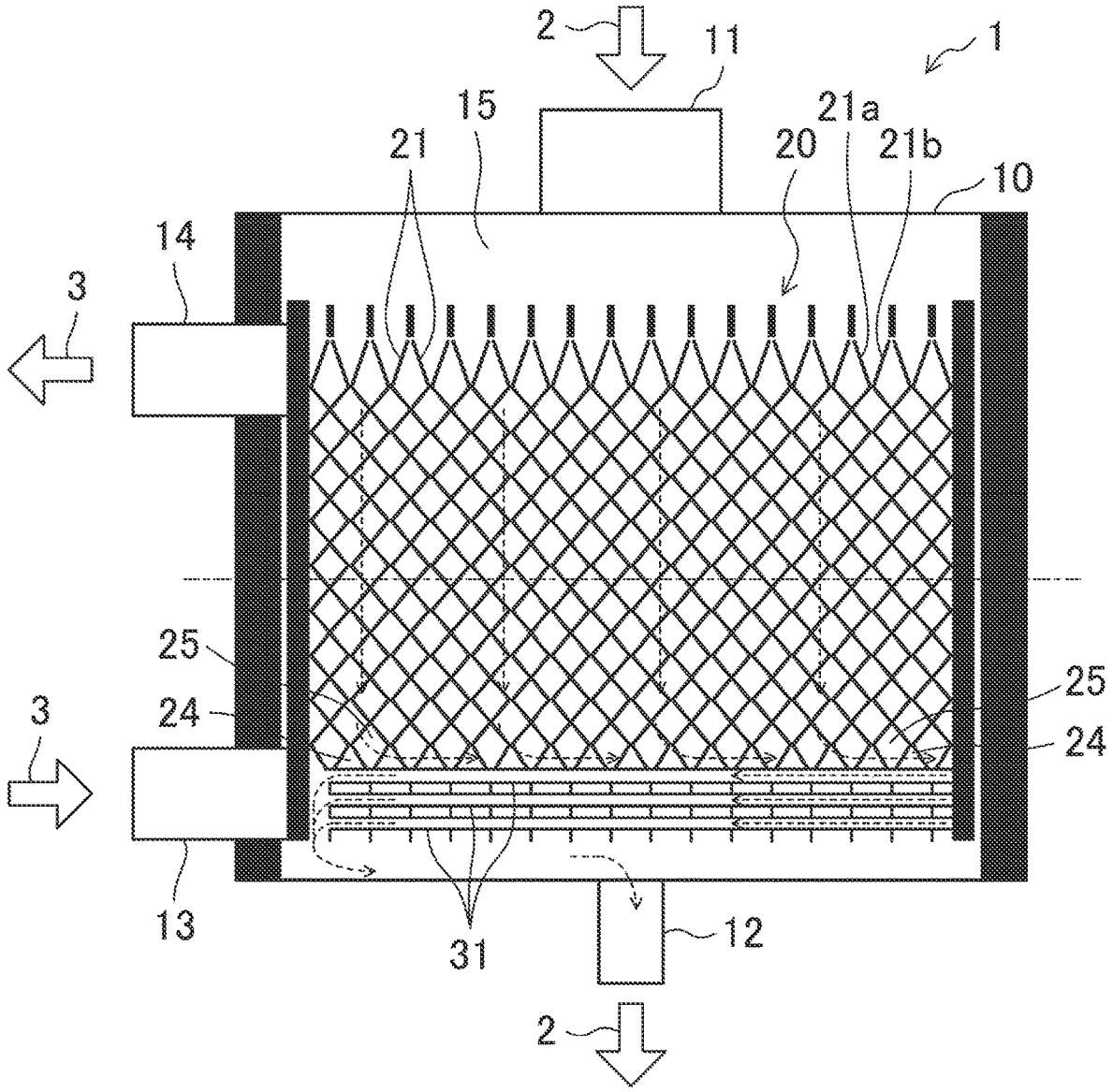
FIG. 14 is a diagram illustrating a cross-sectional configuration of a shell-and-plate heat exchanger according to a third embodiment, as viewed from a horizontal direction perpendicular to a stacking direction of heat transfer plates.
Figure 15:
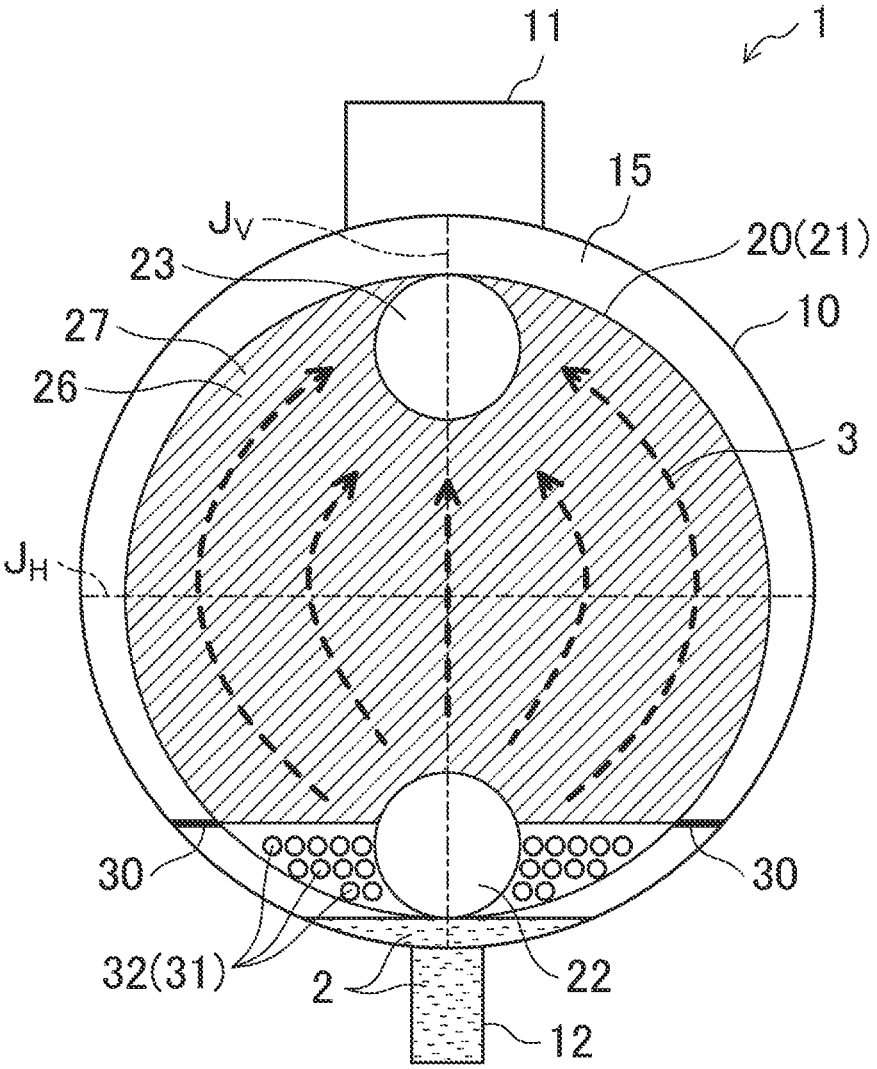
FIG. 15 is a diagram illustrating a cross-sectional configuration of the shell-and-plate heat exchanger according to the third embodiment, as viewed from the stacking direction of the heat transfer plates.
Figure 16:
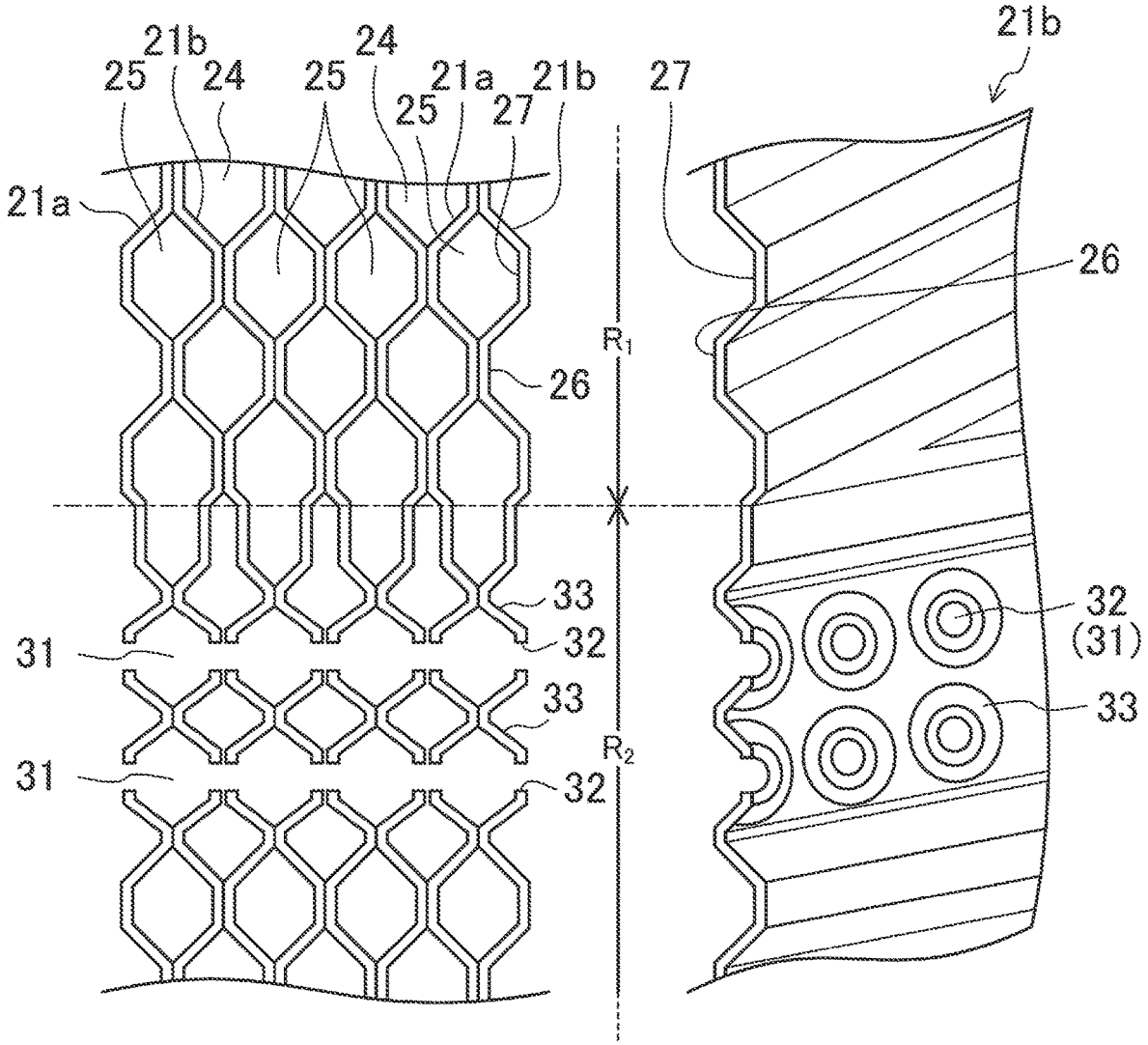
FIG. 16 is a diagram illustrating a cross-sectional configuration of a plate stack of the shell-and-plate heat exchanger according to the third embodiment together with a perspective view of one of the heat transfer plates.

The third embodiment will be described. FIG. 14 is a diagram illustrating a cross-sectional configuration of a heat exchanger (1) of this embodiment, as viewed from a horizontal direction perpendicular to a stacking direction of heat transfer plates (21). FIG. 15 is a diagram illustrating a cross-sectional configuration of the heat exchanger (1) of this embodiment, as viewed from the stacking direction of heat transfer plates (21). FIG. 16 is a diagram illustrating a cross-sectional configuration of a plate stack (20) of the heat exchanger (1) of this embodiment together with a perspective view of one of the heat transfer plates (21). In FIGS. 14 to 16, the same reference characters are used to designate the same elements as those in the first embodiment illustrated in FIGS. 1 to 3. The following description will be focused mainly on the differences between the heat exchanger (1) of this embodiment and the heat exchanger (1) of the first embodiment.

In the first embodiment, as illustrated in FIGS. 1 to 3, a pair of plates (21*a*, 21*b*) sandwiching the refrigerant channel (24) have, on a surface of a lower portion (the supercooling region $R_2$), a corrugated pattern including a recess (28) and a protrusion (29) as a meandering portion that meanders the refrigerant (2) condensed on that surface.

On the other hand, in this embodiment, a communication channel (31) extending inside the plate stack (20) along the stacking direction of the heat transfer plates (21) is provided as the meandering portion, as illustrated in FIGS. 14 to 16. The communication channel (31) may include a plurality of communication channels. The communication channel (31) passes through a lower portion (supercooling region $R_2$) of each heat transfer plate (21*a*, 21*b*). The supercooling region $R_2$ may be provided, for example, on both sides of the first through hole (22) in the horizontal direction, more specifically, on both sides of the first through hole (22) in the horizontal direction except an upper portion of the first through hole (22).

The communication channel (31) may be configured as illustrated in FIG. 16, for example. That is, a pair of heat transfer plates (21*a*, 21*b*) adjacent to each other with the refrigerant channel (24) interposed therebetween in the supercooling region $R_2$ are each provided with, for example, a conical projection (33) having an opening (32) at the top so that the openings (32) of the respective heat transfer plates (21*a*, 21*b*) are opposed to each other and connected to each other. The communication channel (31) extending inside the plate stack (20) along the horizontal direction is formed in this manner.

In this embodiment, a corrugated pattern including the recess (28) and the protrusion (29) of the first embodiment may be provided as a meandering portion in addition to the communication channel (31).

Flows of the refrigerant in the heat exchanger (1) of this embodiment will be described below with reference to FIG. 14. In FIG. 14, flows of the refrigerant are indicated by broken arrows.

Similarly to the first embodiment, the condensed refrigerant (2) that has been condensed on the heat transfer plates (21*a*, 21*b*) in the condensation region $R_1$ flows downward along the corrugated pattern including the recess (26) and protrusion (27) in the condensation region $R_1$. In this embodiment, a plate-shaped member (30) that inhibits entering of the refrigerant (2) between the outer periphery of the supercooling region 1R and the inner wall of the shell (10) has, on the rear side (the side where the heating medium inlet (13) and the heating medium outlet (14) are not provided) in the stacking direction of the heat transfer plates (21) (the longitudinal direction of the heat exchanger (1)), for example, an opening that communicates with the supercooling region 1R. Thus, the refrigerant (2) that has reached the member (30) flows on the member (30) toward the rear side in the longitudinal direction of the heat exchanger (1), and is led from the rear side to one end of the communication channel (31) serving as the meandering portion. The refrigerant (2) led to the one end of the communication channel (31) flows to the front side in the longitudinal direction of the heat exchanger (1), flows down from the other end of the communication channel (31), and is temporarily stored at the bottom of the internal space (15) of the shell (10). The condensed refrigerant (2) is thereafter discharged from the internal space (15) of the shell (10) through the refrigerant discharge port (12).

Advantages of Third Embodiment

According to the heat exchanger (1) of this embodiment, the communication channel (31) extending inside the plate stack (20) along the stacking direction of the heat transfer plates (21) is provided as the meandering portion. The meandering of the condensed refrigerant (2) increases the flow speed of the refrigerant (2), making it possible to ensure the sufficient area for supercooling of the refrigerant (2) on the heat transfer plates (21) and improve the heat exchange efficiency. Further, the refrigerant (2) can meander in the stacking direction of the heat transfer plates (21) (i.e., in the longitudinal direction of the heat exchanger (1)) through the communication channel (31). This can lengthen the channel length of the refrigerant (2), thus enabling stable supercooling of the refrigerant (2).

In the heat exchanger (1) of this embodiment, the following effects are obtainable by the provision of the communication channel (31) serving as the meandering portion on both sides, in the horizontal direction, of the first through hole (22) (the introduction opening for the heating medium (3)) of each heat transfer plate (21). That is, a decrease in the heat exchange efficiency due to the provision of the communication channel (31) that meanders the condensed refrigerant (2) is less likely to occur because both sides of the introduction opening for the heating medium (3) (first through hole (22)) in the horizontal direction are regions that basically contribute less to heat exchange.

In the heat exchanger (1) of this embodiment, the following effects are obtainable by the provision of the member (filling)(30) that inhibits entering of the refrigerant (2) between the outer periphery of the supercooling region $R_2$ in the plate stack (20) where the communication channel (31) is formed, and the inner wall of the shell (10). That is, the aforementioned effects are obtainable with reliability because it is possible to prevent the condensed refrigerant from bypassing the communication channel (31) serving as the meandering portion and flowing between the outer periphery of the plate stack (20) and the inner wall of the shell (10).

Other Embodiments

In the heat exchangers (1) of the first to third embodiments (including the variations), the heat transfer plates (21) forming the plate stack (20) each have a circular shape, but the shape of the heat transfer plate (21) is not particularly limited. For example, the heat transfer plates (21) may have another shape, such as an elliptical shape or a semicircular shape.

In the heat exchangers (1) of the first to third embodiments (including the variations), the heat transfer plates (21) forming the plate stack (20) may be joined together by brazing, for example.

While the embodiments and variations have been described above, it will be understood that various changes in form and details can be made without departing from the spirit and scope of the claims. The above embodiments and variations may be appropriately combined or replaced as long as the functions of the target of the present disclosure are not impaired. In addition, the expressions of "first," "second," and "third" in the specification and claims are used to distinguish the terms to which these expressions are given, and do not limit the number and order of the terms.

As can be seen from the foregoing description, the present disclosure is useful for a heat exchanger.

The invention claimed is:

1. A shell and plate heat exchanger comprising:

a shell forming an internal space; and a plate stack housed in the internal space of the shell, the plate stack including a plurality of heat transfer plates stacked and joined together, the shell and plate heat exchanger being configured to allow a refrigerant that has flowed into the internal space of the shell to be condensed, a refrigerant channel communicating with the internal space of the shell and being configured to allow the refrigerant to flow through, a heating medium channel blocked from the internal space of the shell and being configured to allow a heating medium to flow through, and the refrigerant channel and the heating medium channel being alternately arranged between adjacent plates of the plurality of heat transfer plates, and a meandering portion being provided in a lower portion of the plate stack but no meandering portion being provided in an upper portion of the plate stack, the meandering portion being configured to meander the refrigerant condensed on a surface of each of the plurality of heat transfer plates, the meandering portion being provided by processing the plurality of heat transfer plates.

2. The shell and plate heat exchanger of claim 1, wherein a member that inhibits entering of the refrigerant is provided between an outer periphery of a region in the plate stack where the meandering portion is disposed, and an inner wall of the shell, and the member is positioned higher than a bottom of each of the plurality of heat transfer plates.

3. The shell and plate heat exchanger of claim 1, wherein the meandering portion includes a recess and a protrusion on a surface of at least one of a pair of the plurality of plates sandwiching the refrigerant channel.

4. The shell and plate heat exchanger of claim 2, wherein the meandering portion includes a recess and a protrusion on a surface of at least one of a pair of the plurality of plates sandwiching the refrigerant channel.

5. The shell and plate heat exchanger of claim 1, wherein the meandering portion includes a communication channel extending inside the plate stack along a stacking direction of the plurality of heat transfer plates.

6. The shell and plate heat exchanger of claim 2, wherein the meandering portion includes a communication channel extending inside the plate stack along a stacking direction of the plurality of heat transfer plates.

7. The shell and plate heat exchanger of claim 3, wherein the meandering portion includes a communication channel extending inside the plate stack along a stacking direction of the plurality of heat transfer plates.

8. The shell and plate heat exchanger of claim 1, wherein the lower portion of the plate stack is disposed below a horizontal axis passing through a center of the heat transfer plates, and the upper portion of the plate stack is disposed above the lower portion.

9. The shell and plate heat exchanger of claim 8, wherein the lower portion includes a supercooling region and the upper portion includes a condensation region.

10. The shell and plate heat exchanger of claim 1, wherein the meandering portion includes a channel extending horizontally along the surface of each of the plurality of heat transfer plates or along the stacking direction of the plurality of heat transfer plates.

11. A shell and plate heat exchanger comprising:

a shell forming an internal space; and a plate stack housed in the internal space of the shell, the plate stack including a plurality of heat transfer plates stacked and joined together, the shell and plate heat exchanger being configured to allow a refrigerant that has flowed into the internal space of the shell to be condensed, a refrigerant channel communicating with the internal space of the shell and being configured to allow the refrigerant to flow through, a heating medium channel blocked from the internal space of the shell and being configured to allow a heating medium to flow through, and the refrigerant channel and the heating medium channel being alternately arranged between adjacent plates of the plurality of heat transfer plates, and a meandering portion being provided in at least a lower portion of the plate stack, the meandering portion being configured to meander the refrigerant condensed on a surface of each of the plurality of heat transfer plates, the meandering portion being provided by processing the plurality of heat transfer plates, each of the plurality of heat transfer plates having a lower portion with a first through hole serving, as an introduction opening for the heating medium, and the meandering portion being disposed on both sides of the first through hole in a horizontal direction.

12. The shell and plate heat exchanger of claim 11, wherein a member that inhibits entering of the refrigerant is provided between an outer periphery of a region in the plate stack where the meandering portion is disposed, and an inner wall of the shell, and the member is positioned higher than a bottom of each of the plurality of heat transfer plates.

13. The shell and plate heat exchanger of claim 11, wherein the meandering portion includes a recess and a protrusion on a surface of at least one of a pair of the plurality of plates sandwiching the refrigerant channel.

14. The shell and plate heat exchanger of claim 11, wherein the meandering portion includes a communication channel extending inside the plate stack along a stacking direction of the plurality of heat transfer plates.

15. The shell and plate heat exchanger of claim 11, wherein the meandering portion includes a channel extending horizontally along the surface of each of the plurality of heat transfer plates or along the stacking direction of the plurality of heat transfer plates.

* * * * *